US009661978B2

(12) United States Patent
Cavallaro

(10) Patent No.: US 9,661,978 B2
(45) Date of Patent: May 30, 2017

(54) SPRAYING DEVICE FOR A WASHING MACHINE

(71) Applicant: Indesit Company S.p.A., Fabriano (IT)

(72) Inventor: Roberta Cavallaro, Grugliasco (IT)

( * ) Notice: Subject to any disclaimer, the term of this patent is extended or adjusted under 35 U.S.C. 154(b) by 0 days.

(21) Appl. No.: 14/655,771

(22) PCT Filed: Dec. 27, 2013

(86) PCT No.: PCT/IB2013/061361
§ 371 (c)(1),
(2) Date: Jun. 26, 2015

(87) PCT Pub. No.: WO2014/102738
PCT Pub. Date: Jul. 3, 2014

(65) Prior Publication Data

US 2016/0000295 A1 Jan. 7, 2016

(30) Foreign Application Priority Data

Dec. 28, 2012 (IT) ..... PR2012A0091

(51) Int. Cl.
*A47L 15/23* (2006.01)
*A47L 15/42* (2006.01)
*B05B 3/04* (2006.01)

(52) U.S. Cl.
CPC ..... *A47L 15/4219* (2013.01); *A47L 15/23* (2013.01); *A47L 15/428* (2013.01); *A47L 15/4278* (2013.01); *A47L 15/4282* (2013.01); *B05B 3/0486* (2013.01)

(58) Field of Classification Search
CPC .. A47L 15/23; A47L 15/4219; A47L 15/4278; A47L 15/428; A47L 15/4282; B05B 3/0486
USPC ..... 134/56 D, 57 D, 58 D, 172, 180, 198, 134/199, 200
See application file for complete search history.

(56) References Cited

U.S. PATENT DOCUMENTS

2005/0133070 A1 6/2005 Vanderroest et al.
2010/0116301 A1* 5/2010 Heisele ..... B05B 3/0486 134/172
2012/0037193 A1* 2/2012 Bayer ..... A47L 15/23 134/180

FOREIGN PATENT DOCUMENTS

DE 102007017114 A1 10/2008
EP 1232720 A2 8/2002
EP 1382287 A2 1/2004

OTHER PUBLICATIONS

ISR International Patent Application No. PCT/IB2013061361, filed Dec. 27, 2013 mailed date Apr. 8, 2014, Applicant: Indesit Company SPA. International Publication No. WO2014102738A1, publication date: Jul. 3, 2014.

(Continued)

*Primary Examiner* — Michael Barr
*Assistant Examiner* — Levon J Shahinian
(74) *Attorney, Agent, or Firm* — McGarry Bair PC

(57) ABSTRACT

Spraying device for washing machine, in particular a dishwasher, comprising an impeller provided with blades on the upper part as to receive an axial flow of a washing fluid and to deviate said flow in substantially radial direction, a lower cage defining a containment compartment having an upper access opening for the insertion of the impeller, and an upper closing cover, firmly applicable superiorly on the top of the cage to close the containing compartment.

12 Claims, 11 Drawing Sheets

(56) References Cited

OTHER PUBLICATIONS

International Patent Application No. PCT/IB2013061361, filed Dec. 27, 2013, Applicant: Indesit Company SPA. International Publication No. WO2014102738A1, publication date: Jul. 3, 2014.

* cited by examiner

Fig.6
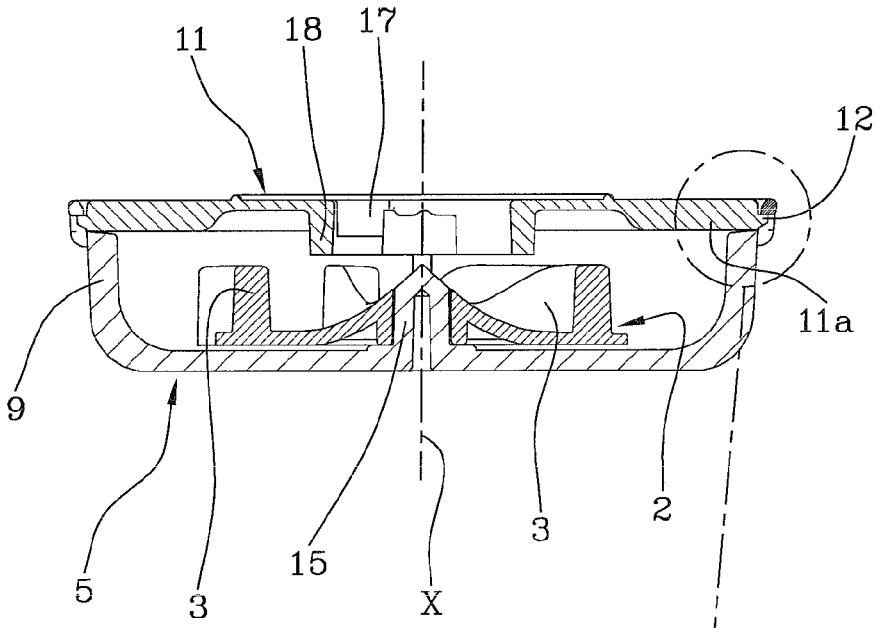
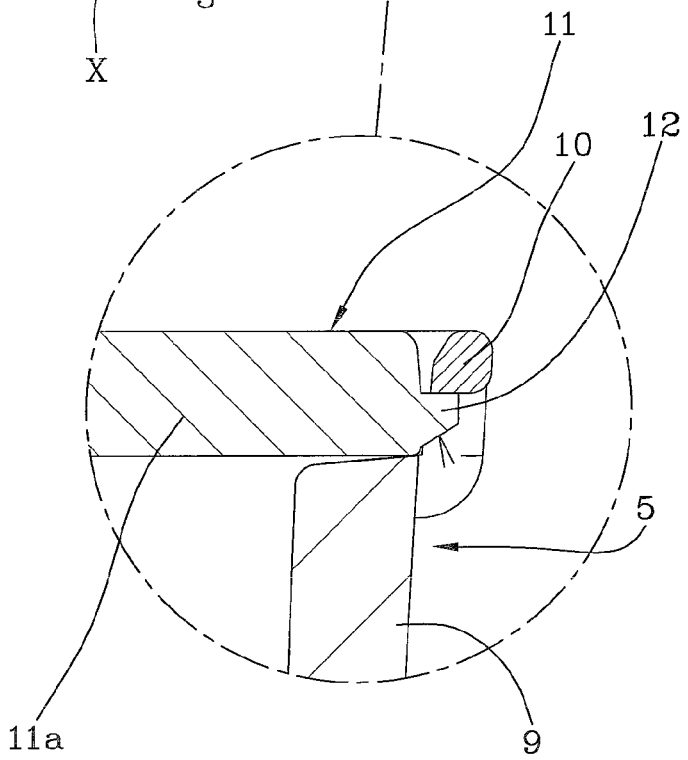
Fig.6A

SPRAYING DEVICE FOR A WASHING MACHINE

TECHNICAL FIELD

The present invention relates to a spraying device for washing machine, in particular a dishwasher. This spraying device is of rotary type and, in particular, it is suitable to be placed on top of the washing machine to spray a falling jet downward. Furthermore, the object of the invention consists of a washing machine, preferably a dishwasher, provided with the said spraying device.

STATE OF THE ART

Are currently known dishwashers provided with rotating spraying device which may be substantially of two types:

- rotating arm equipped with spraying holes along the entire length of the arm, particularly suitable for example to be arranged below a respective rack; or
- in the form of an impeller with blades, rotatable around a vertical axis and suitable to receive an axial flow (from a nozzle of a hydraulic circuit of the dishwasher) and to supply a radial flow which, by gravity, determines a sprinkling flow.

With reference to this second type, known spraying devices comprise a support cage equipped with lateral openings and within which is rotationally disposed the impeller. The support cage has two lateral appendages of connection, mutually opposing, designed to stably engage to a special fastening flange formed on the upper wall of the washing compartment of dishwasher. These connection appendages are elastically deformable to allow a removable snap-fit engagement with the said fastening flange.

The Applicant has observed that the spraying devices of the above described type are improvable both from fluid-tight point of view and from simplicity of sprayer assembly and disassembly point of view.

In fact, said snap-fit engagement realized by appendages with the fastening flange requires to exercise a not indifferent strength to disassemble the cage from the dishwasher and this, beyond to create difficulties to the operator that has to operate in an often uncomfortable and not very accessible location, can cause excessive deformation of the cage. It should be considered in fact that the cage has very thin walls just to maximize the wideness of the lateral openings intended to allow the escape of the radial flow delivered by the impeller.

Furthermore, there is not a specific fluid tight between the fastening flange and the impeller, therefore the inlet axial flow to the impeller is not controlled and can became an irregular flow such as to compromise an optimal fluid-dynamic behavior of the impeller itself.

AIM OF THE INVENTION

Therefore, object of the present invention is to provide a spraying device for washing machine, in particular a dishwasher, which overcomes the above mentioned drawbacks of prior art.

In particular, it is a purpose of the present invention to provide a spraying device for washing machine, in particular a dishwasher, which is easily assembled and disassembled.

It is also purpose of the invention to provide a spraying device for washing machine, in particular dishwasher, which presents an excellent fluid dynamic behavior.

BRIEF DESCRIPTION OF THE DRAWINGS

The above illustrated purposes, and others, are fully achieved by the spraying device according to the present invention, which is characterized by the contents of the claims indicated below.

The technical characteristics of the invention, according to the above purpose, are clearly seen from the content of the attached claims, and its advantages will become more evident in the detailed description that follows, made with reference to the attached drawings, which provided a preferred embodiment for purely illustrative purposes and not limiting, in which:

FIG. 6 shows a sectional view of the sprinkling device of FIG. 5, according to a plane passing through the central axis of the spraying device;

FIG. 6A illustrates an enlarged detail of the view of FIG. 6;

Figure 17:
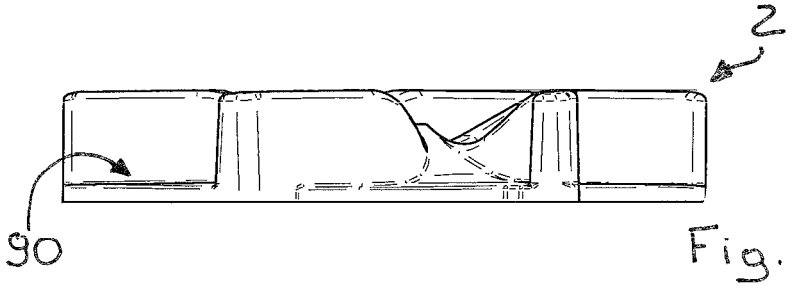
Figure 16:
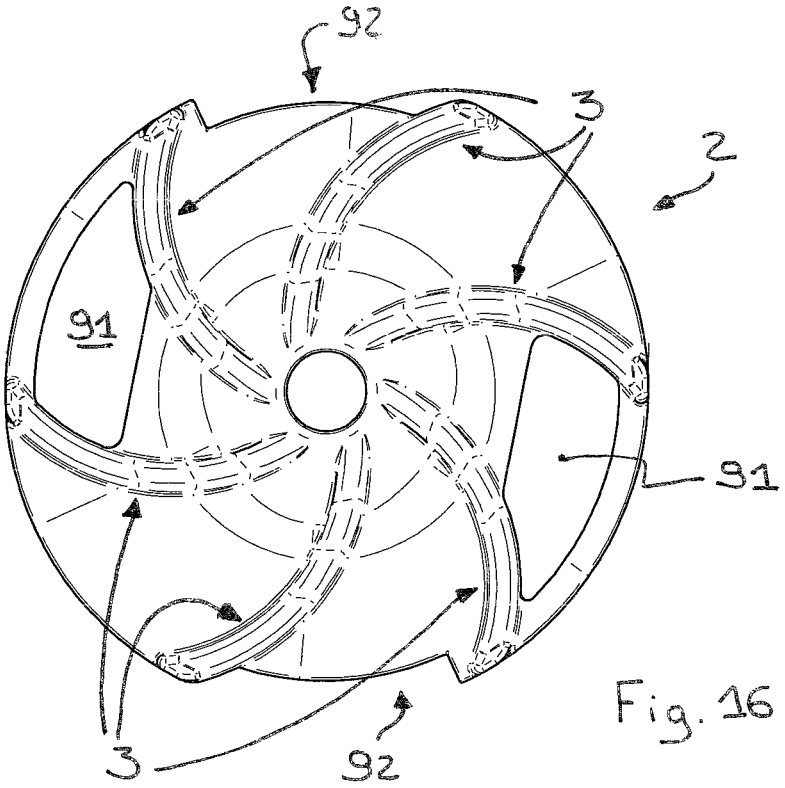

the FIGS. 16 and 17 illustrate two orthogonal views of a component of the spraying device.

DETAILED DESCRIPTION OF PREFERRED EMBODIMENTS OF THE INVENTION

Figure 1:
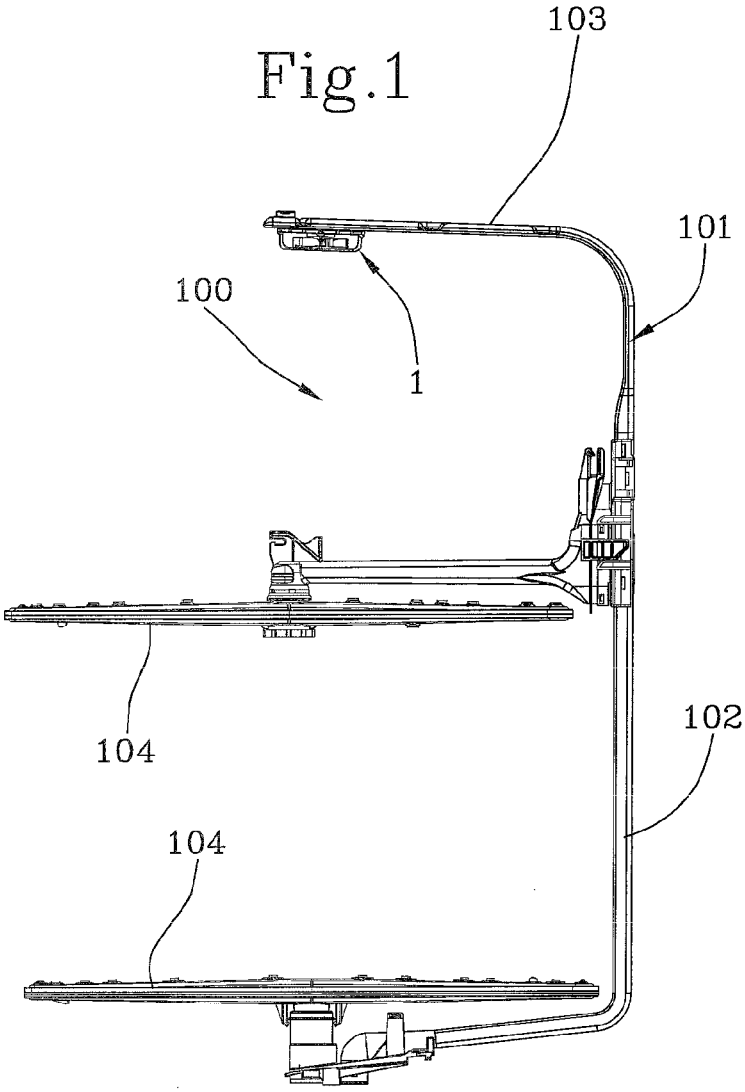
FIG. 1 shows a schematic side view of a hydraulic circuit of a dishwasher provided with a spraying device according to the present invention.
Figure 2:
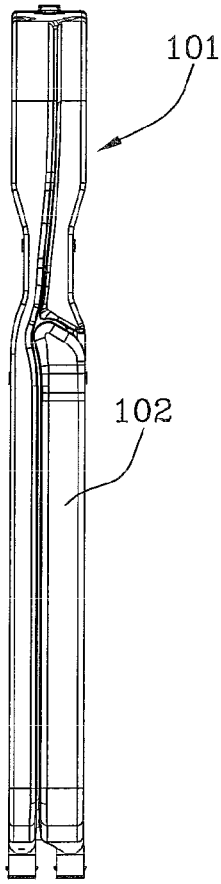
FIG. 2 shows a rear view of the hydraulic circuit of FIG. 1.

In accordance with the FIGS. 1 and 2, with 100 is overall represented a portion of hydraulic circuit of a washing machine. In the following description, reference will be made to a dishwasher, however, the teachings according the present invention are also applicable to different types of washing machines.

The hydraulic circuit 100 is suitable for circulation of a washing fluid which can be simply water or a mix of water and cleaner.

The hydraulic circuit 100, in the portion visible in FIGS. 1 and 2, comprises conveying means 101 of a washing fluid which conveniently extend inside the washing chamber of the dishwasher, in particular from the base of the cleaning chamber until the top of it.

In the specific illustrated embodiment, the conveying means 101 comprise a substantially horizontal top section 103. In the preferred embodiment the conveying means 101 comprise a first conduit 103 that feeds the spraying device 1 and which belongs to the said top section 103, a second and a third conduit which supply corresponding rotating spray arms 104 (FIG. 2 shows the second conduit 102).

To the conveying means 101 is associated with at least a rotating spray arm 104 (two in the embodiment illustrated in FIGS. 1 and 2) of the type with rotating arm hinged at the centerline and having a plurality of nozzles aligned along the arm. The washing fluid dispensed from the nozzles of each rotating sprayer 104 is directed in a direction substantially parallel to the rotational axis of the arm. The washing fluid is fed to each rotational sprayer using the conveying means 101.

Figure 11:
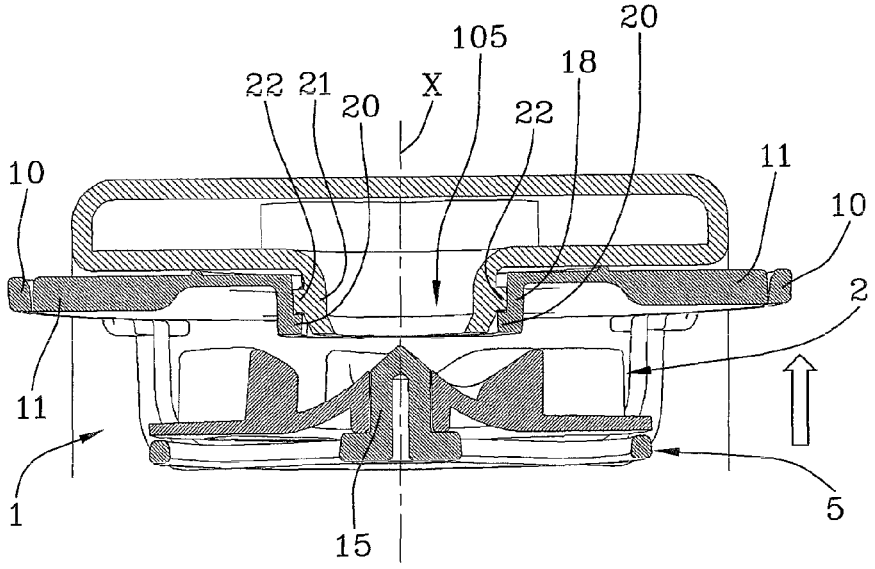
FIGS. 11 and 12 show two sectional views of the spraying device according the invention in two different planes passing through the central axis of the spraying device.
Figure 12:
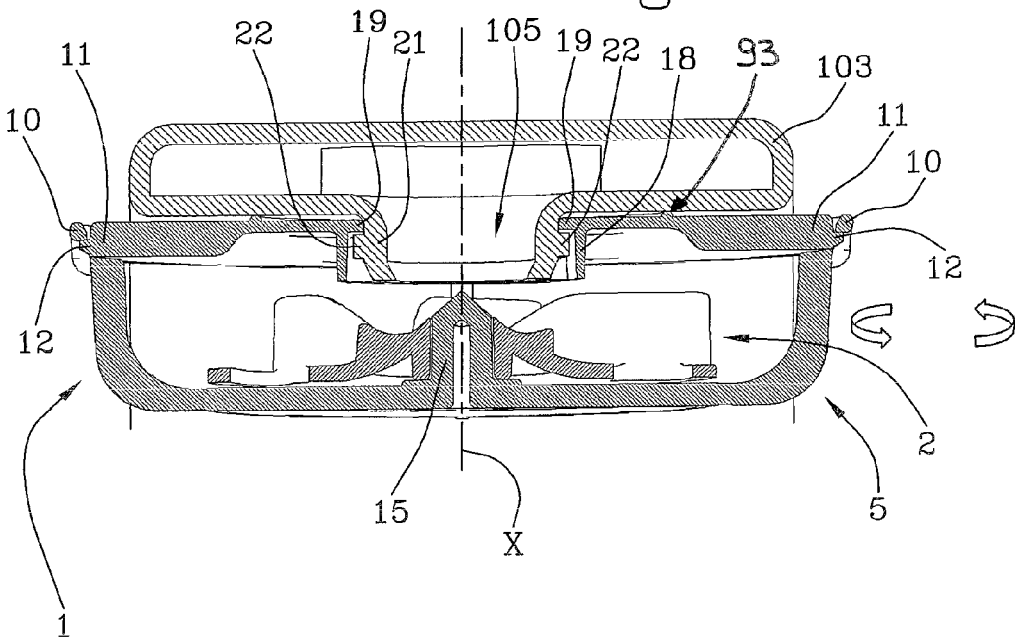
Figure 15:
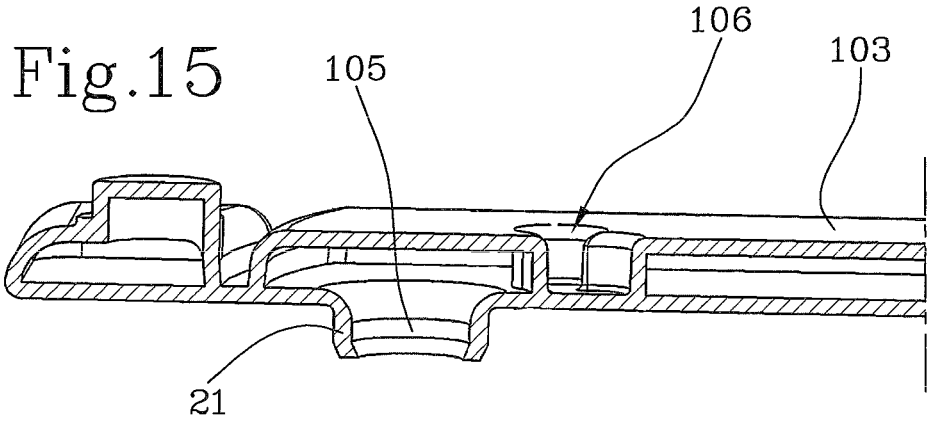
FIG. 15 shows a sectional view of the top section of the hydraulic circuit of FIG. 1 according to a vertical longitudinal plane.

The top section 103 of the conveying means 101 have an outlet opening 105, visible in FIGS. 11, 12 and 15, suitable for spray a flow of washing fluid inside the washing chamber.

In correspondence of the top section 103 of the conveying means 101, and in particular to a free end of the top section 103, is instead applied a spraying device 1 according to the present invention. The spraying device 1 is applied in correspondence to said outlet opening 105 and receives directly from it the flow of the washing fluid to sprinkle inside the washing chamber.

The spraying device 1, shown in detail in FIGS. 3 to 6, comprises an impeller 2 having a vertical axis of rotation "X" and having an upper surface equipped with blades 3, which are configured so as to receive an axial flow (i.e. along the "X" axis of rotation) of a washing fluid, coming from said outlet opening 105, and deviate said flow in a substantially radial direction (i.e. transversely, preferably perpendicularly, to the "X" axis of rotation).

The blades extend themselves moving away from the rotational axis "X" of the impeller 2 and define between them respective channels 4 to guide the washing fluid.

The radial flow of the washing fluid coming out from the impeller 2 undergoes subsequently, by the gravity action, a downward deviation to define a sprinkling on the underlying rack (not shown) containing objects to be washed. The sprinkling defines a kind of umbrella whose diameter depends on the rotational speed of the pumping means of the washing fluid to the impeller 2.

Conveniently, the impeller 2 has six blades 3. The radius of curvature of said blades 3 is constant. Conveniently, it could be between 12 and 15 millimeters. Advantageously, the external diameter of the impeller 2 is comprised between 40 and 50 millimeters, preferably is comprised between 44 and 45 millimeters. The development of the impeller 2 along the rotational axis X is comprised between 6 and 9 mm.

Conveniently the impeller 2 comprises a rear wall 90 that develops transversely to an axis of rotation X of the impeller 2 and from which the blades 3 develop. The wall 90 comprises at least one fluid dispensing opening 91, 92 which allows the fluid to cross said rear wall 90 at a smaller diameter than an outer diameter of the impeller 2 (this in order to spray adequately any crockery arranged below of the impeller and in the nearly of the same axis of rotation X).

This opening 91, 92 may be a hole 91 entirely surrounded by rear wall 90. The hole 91 may be interposed between two blades 3 of the impeller 2. In particular, this hole 91 may connect two blades 3 consecutive of the impeller 2. This opening may be an inlet 92 obtained along the outer diameter of the impeller 2. Conveniently may be present both said hole 91 and said inlet 92. Conveniently may be present a pair of said holes 91 and/or a pair of said inlets 92 (being said holes and said inlets diametrically opposite).

The spraying device 1 also comprises a lower cage 5 substantially designed to support the impeller 2 and internally defining a containment compartment 6 having an upper access opening 7 to allow an insertion of the impeller 2 in the containment compartment 6. The upper access opening 7 has, therefore, transverse dimensions greater than the impeller 2, to allow its insertion and extraction. The cage 5 has lateral and/or lower openings 8 for the delivery of flow coming out from the impeller 2. These lateral openings 8 preferably affect a preponderant part of the lateral overall dimension of the cage 5. Lower openings 8 affect a preponderant part of the lower overall dimension. Preferably, the cage 5 has a structure defined by lateral arms 9 defining, between them, the above-mentioned openings 8.

Superiorly, the cage 5 has a connection ring 10 which peripherally delimits the upper access opening 7 which function will be better later described. The connection ring 10 is fastened to the upper ends of the said side arms 9.

Advantageously, the spraying device 1 also comprises an upper closing cover 11, firmly applicable on the top of cage 5 in correspondence of the upper access opening 7 to close the containment compartment 6 from above.

Preferably, the cover 11 has a substantially discoidal shape. As shown in detail in FIGS. 11 and 12, the cover 11 has, on its own bottom surface, facing the impeller 2, a lowering 11*a* facing the impeller 2 and arranged in a peripheral portion far from the rotation axis "X".

Such lowering 11*a*, having an axis-asymmetrical shape around the axis of rotation "X", is connected to the central part of the cover 11 and defines a deflector that deviates downwards any flow coming out from the impeller 2, for example, portions of the flow that impact against the upper surface of the impeller 2 and come bounced back (in undesired way) upward and not properly deviated in the radial direction.

The cover 11 has an outer peripheral edge 11*b* which substantially complementarily to said connecting ring 10 in order to be firmly engaged to the connection ring 10.

Preferably, the outer peripheral edge 11*b* of the cover 11 and the connection ring 10 are removably connected together through one or more elastic snap-fit engagements 12. In the embodiment illustrated in FIGS. 3-6, there are four elastic snap-fit engagements 12 in the form of teeth arranged on the outer peripheral edge 11*b* of the cover and angularly equally spaced 90 degrees around the axis "X".

The four teeth are snap-fit engageable (for example through pressure, by means of mutual approach of the cover 11 and the cage 5) on the equivalent receiving portions performed on the connection ring 10. Conveniently, the cover 11 comprises a spacer 93 that projects upward and which is in contact with the conveying means 101. This spacer 93 allows to maintain a predetermined distance along the rotation axis X between the conveying means 101 and the cover 11 (it, therefore, facilitates the assembly). The spacer 93 may be annular. Conveniently it is made in one piece with the cover 11.

Since the spraying device 1 is configured to be applied to the conveying means 101 in correspondence to the cover 11, the cover 11 has a hole 13 for feeding the said axial flow of washing fluid to the impeller 2. This hole 13 is preferably central and arranged coaxially to the rotation axis "X" of the impeller 2.

Figure 3:
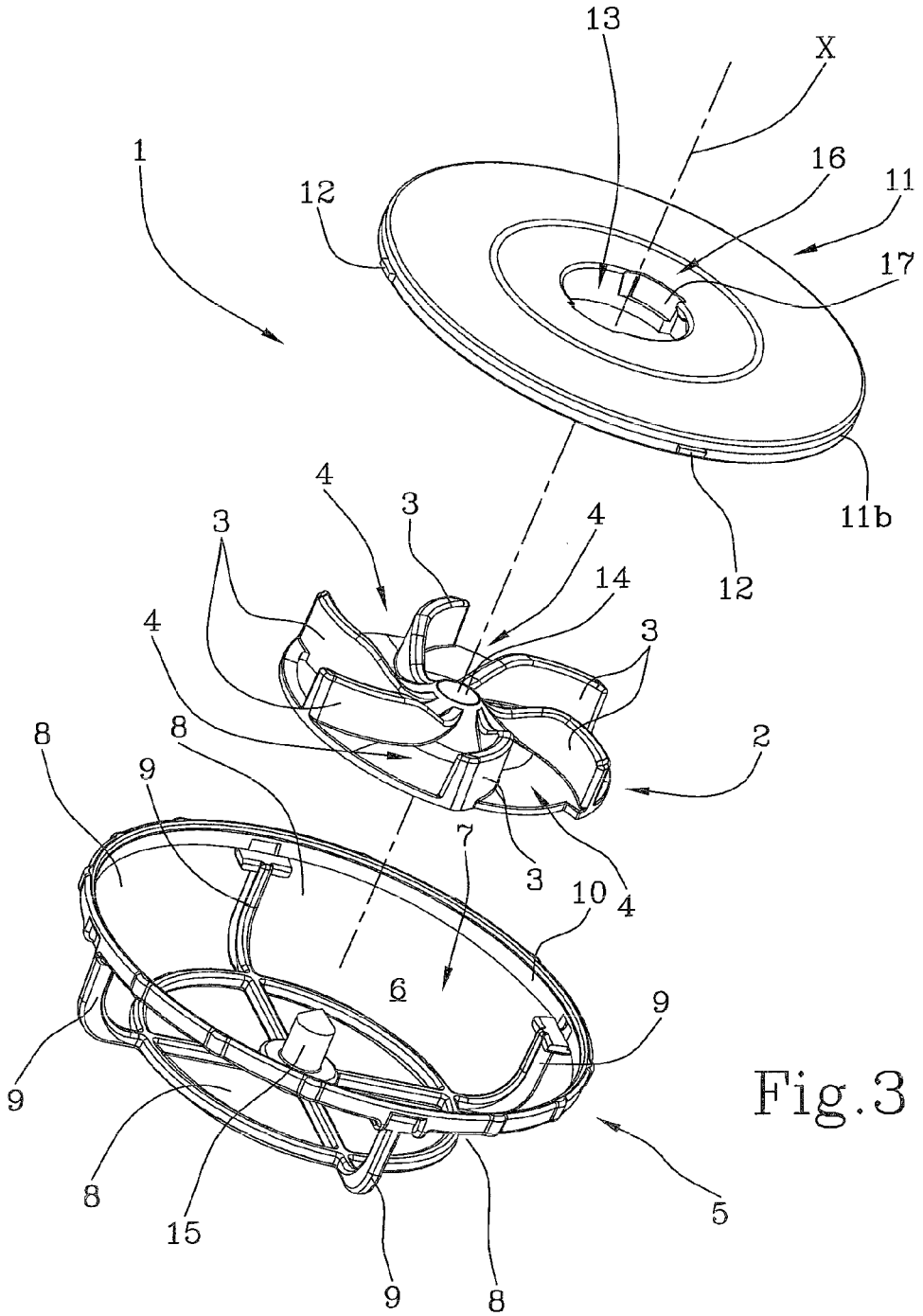
FIG. 3 shows a detailed view of a spraying device according to the present invention.
Figure 4:
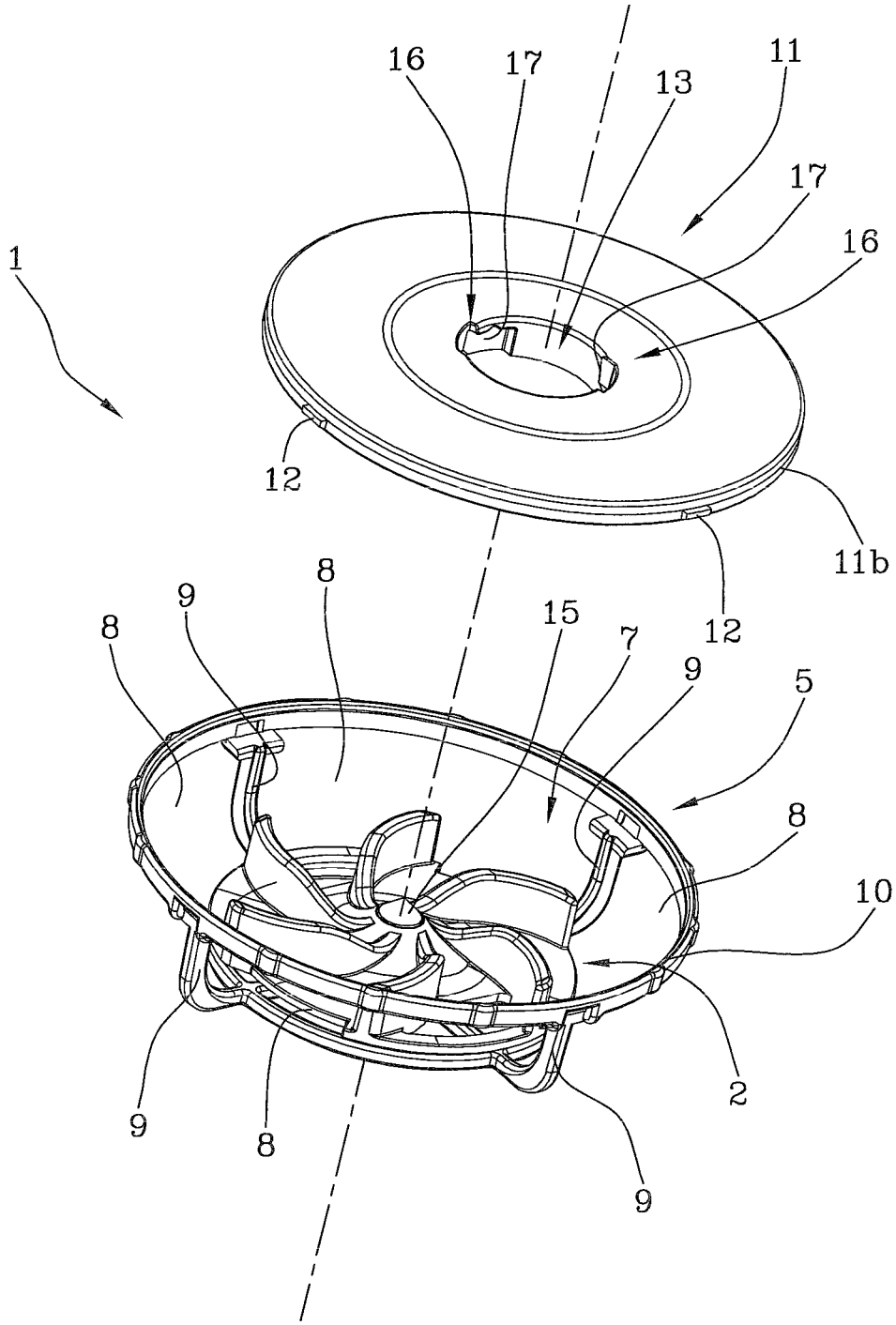
FIG. 4 shows a partially exploded view of the spraying device of FIG. 3.
Figure 5:
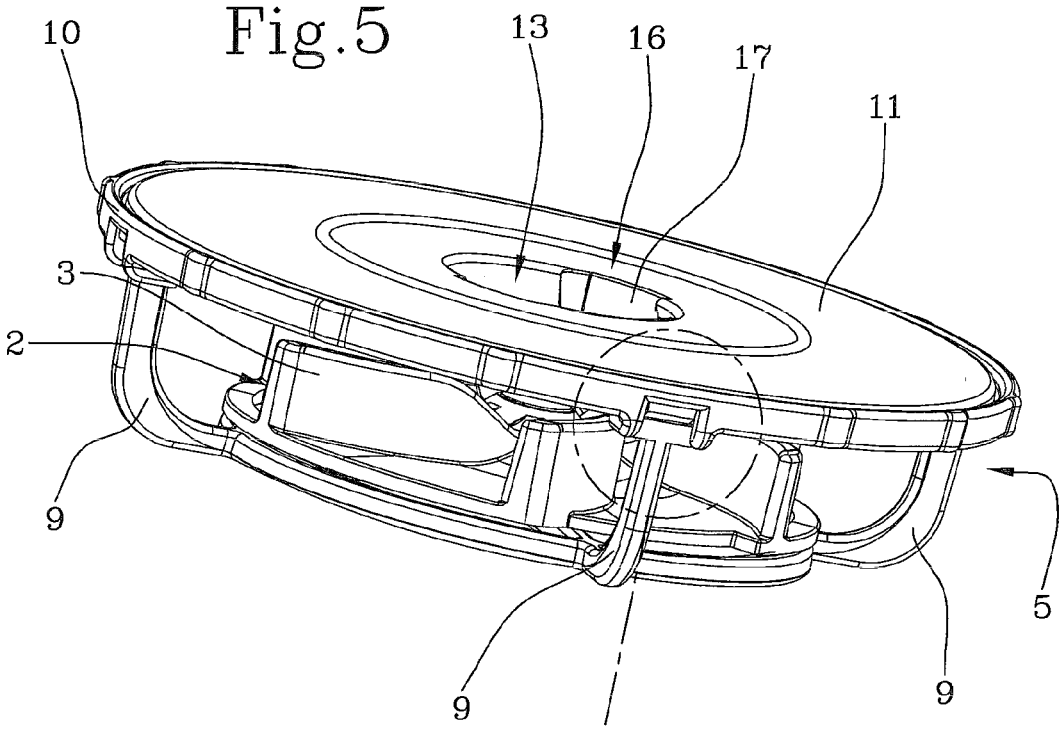
FIG. 5 illustrates the spraying device according to the present invention in an assembled configuration.
Figure 5A:
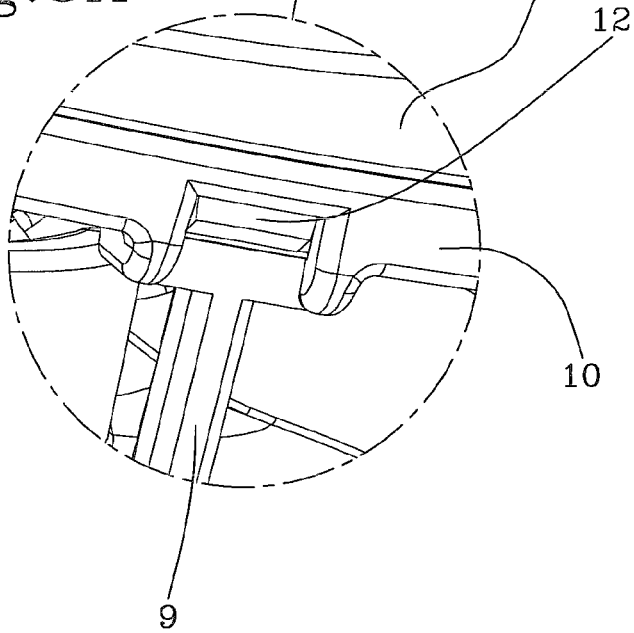
FIG. 5A illustrates an enlarged detail of the spraying device of FIG. 5.

As shown in FIGS. 3 and 4, the impeller 2 has a central through hole 14 and the cage 5 has a pin 15 insertable in the central hole 14 of the impeller 2 in such a way as to provide a rotatable support for the impeller 2 around the axis "X".

The pin 15 has a conical tip overlooking from said (upper) surface of the impeller 2 at least during a work configuration of the impeller (that is the normal operation configuration of the impeller 2, illustrated in FIG. 4).

This conical tip of the pin 15 optimizes the fluid dynamic behavior of the flow of the impeller 2 since it achieves a first partition in radial direction of the axial flow coming from the conveying means 101.

Advantageously, moreover, the blades 3 of the impeller 2 have, at the central through hole 14 of the impeller 2, a profile radiused to said conical tip of the pin. This further improves the fluid-dynamic behavior of the impeller 2 as it makes more uniform and regular the deviation in radial direction of the axial flow inlet to the impeller 2.

The spraying device 1 also comprises fastening means 16 providing to firmly connect the cage to the frame 5 of the dishwasher, in particular to the lower surface of the top section 103 of the conveying means 101. Advantageously, the fastening means 16 are at least partially realized on the cover 11. In particular, part of the fastening means 16 is realized on the cover 11 and part on the lower surface of the top section 103 of the conveying means 101.

In the specific illustrated embodiment, and as shown in detail in FIGS. 7-12, the fastening means 16 comprise a reversible bayonet connection.

In one embodiment, shown in the attached figures, the fastening means 16 comprise a bayonet connection seat 17 realized at the central hole 13 of the cover 11.

In more detail, as shown in FIGS. 11 and 12, the bayonet seat connection 17 is defined by a coupling flange 18 of the cover 11 extending along the rotation axis "X" towards the inside of the containment compartment 6. Such coupling flange 18 thus constitutes a protrusion that extends from a discoidal portion of the cover 11 in the direction of the impeller 2.

The coupling flange 18 therefore presents internally a pair of prominences 19, 20 axially spaced apart (along the rotation axis "X") and angularly staggered from each other around the axis "X" to realize the aforementioned bayonet operation.

In a complementary manner, the lower surface of the top section 103 of the conveying means 101 presents a sleeve 21 extending downwardly and insertable into the central hole 13 of the cover 11, in particular in the coupling flange 18.

The sleeve 21 has at least one radial protrusion 22 which is adapted to insert, with bayonet operation, in the above-mentioned bayonet seat connection 17. In particular, the radial projection 22 is insertable into the flange 18 until the radial protrusion 22 is in contact with a first prominence 20 of the flange 18 itself (see FIG. 11).

Figure 7:
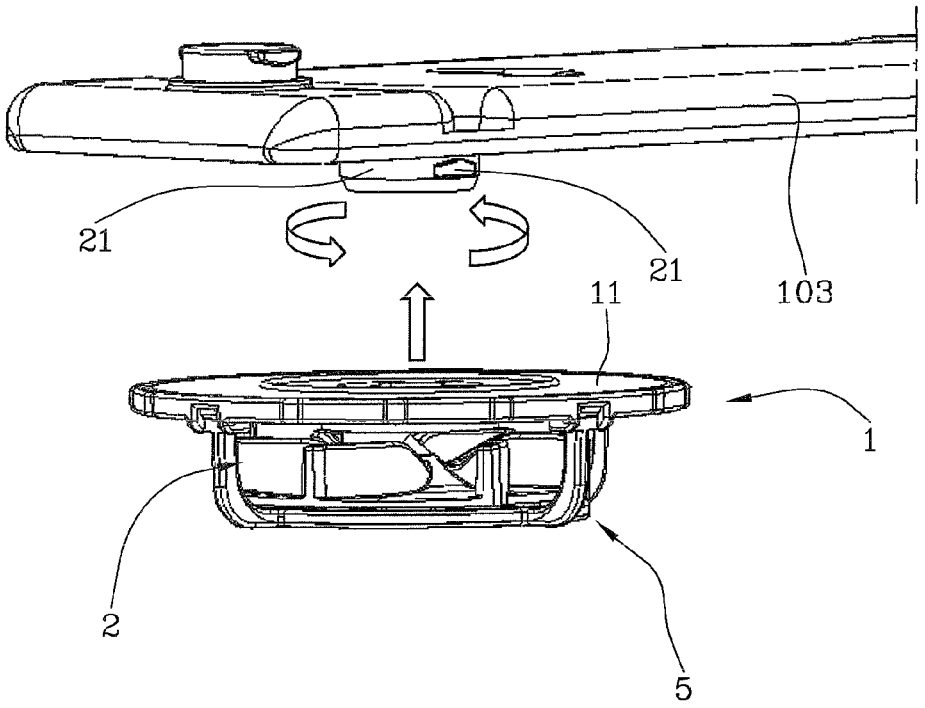
FIG. 7 shows an assembling step of the spraying device according to the invention on the hydraulic circuit of FIG. 1.
Figure 8:
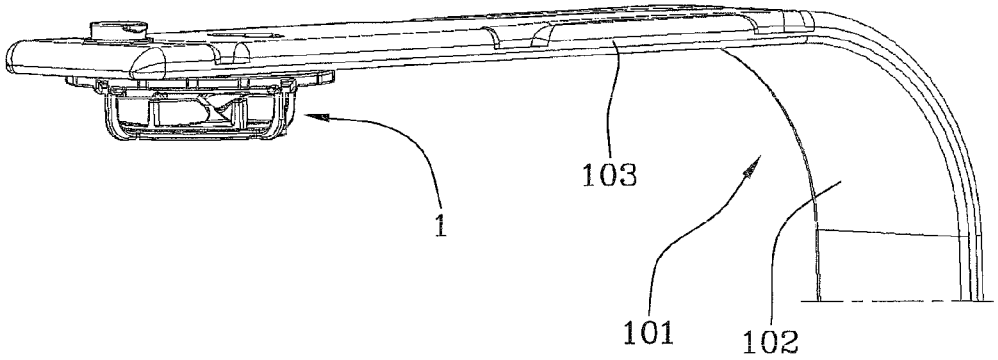
FIG. 8 shows the spraying device according to the invention after completed mounting on the hydraulic circuit of FIG. 1.
Figure 9:
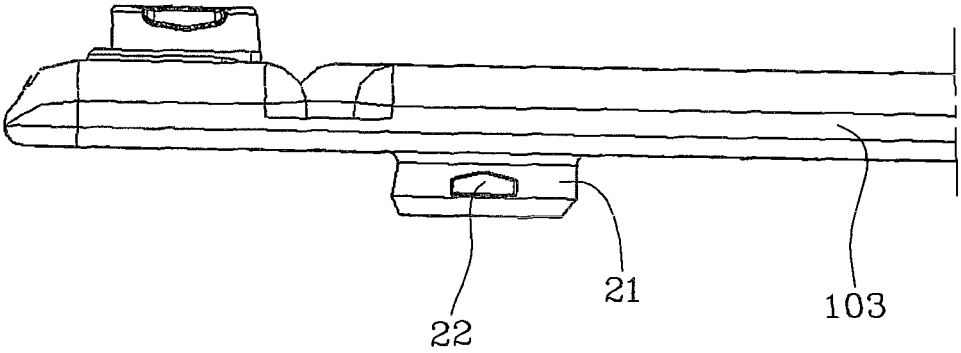
FIG. 9 shows a side view of a top portion of the hydraulic circuit of FIG. 1 responsible for the connection with the spraying device according to the invention.
Figure 10:
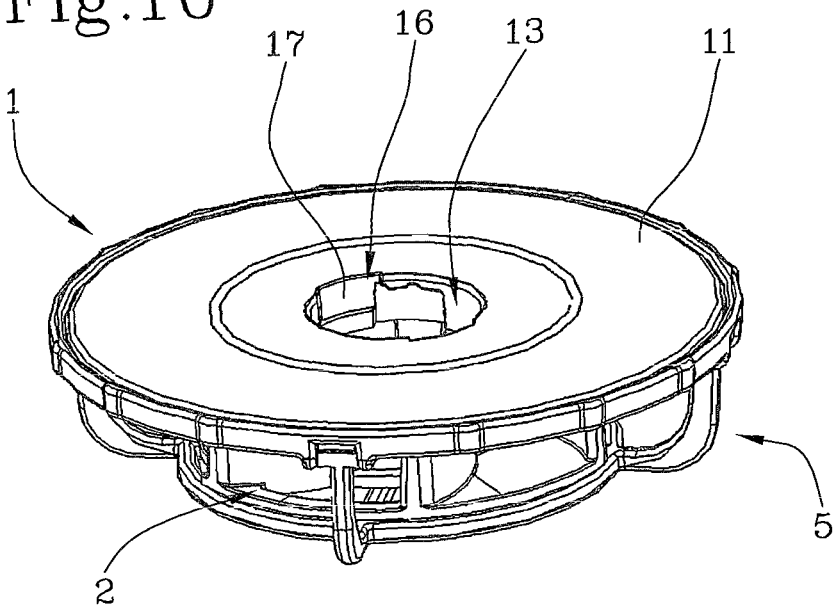
FIG. 10 shows the spraying device according to the invention by an angle that shows the fastening means with the hydraulic circuit of FIG. 1.

Conveniently this insertion provides a displacement along the rotation axis X in such a way that a subsequent rotation of the spraying device 1 around the axis "X" determines a stable interlocking of the radial protrusion 22. The extraction in this case is in fact prevented by the second prominence 19 of the flange 18 (see FIG. 12 in which the radial protrusion 22 is placed between the second prominence 19 and the cage 5). Preferably, this rotation is about 90 degrees (FIGS. 7 and 8). Advantageously, the bayonet connection seat 17 is made in such a way that the thrust of the flow of washing fluid onto the impeller 2 determines a rotation of the impeller 2 in the same direction as the closing direction of bayonet connection 16.

Preferably, according to the illustrated embodiment, the fastening means 16 comprise two bayonet seat 17 diametrically opposite one another and two corresponding radial protrusion 22, which are also diametrically opposed one another realized on the sleeve 21.

According to an embodiment not illustrated, the bayonet connection can be realized in such a way that the bayonet seat 17 is realized on the top section 103 of the conveying means 101 and that the sleeve 21 is realized above the cover 11.

According to an advantageous aspect of the invention, the top section 103 presents, upstream of the outlet opening 105, a flow regulator 106 having front dimensions such as to split the conduit into two channels 107, 108 which reach each other upstream, or at, said outlet opening 105. The flow regulator 106 is one piece with the top section 103 of the conduit.

Figures 13, 13A:
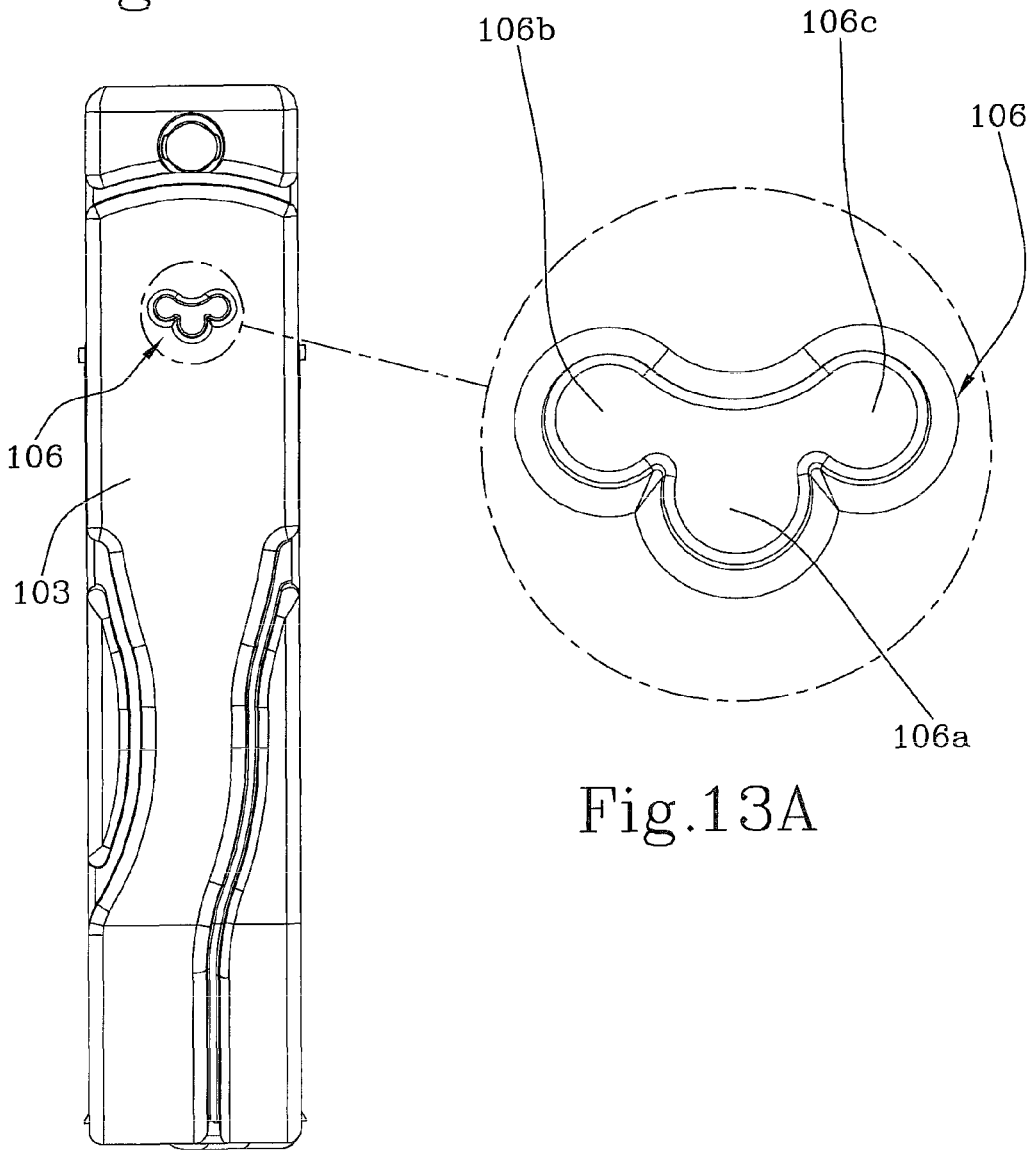
FIG. 13 illustrates a plan view of the hydraulic circuit of FIG. 1.
FIG. 13A illustrates an enlarged detail of the view of FIG. 13.
Figure 14:
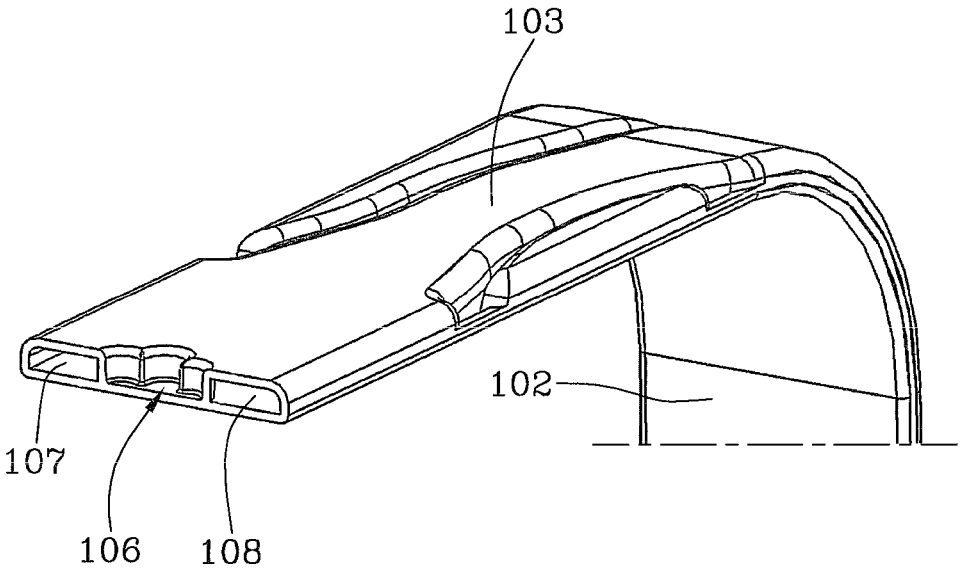
FIG. 14 shows a three dimensional and sectional view of the top section of the hydraulic circuit of FIG. 1.

In more detail, as seen in FIGS. 13-15, the flow regulator 106 has a three-lobed shape having a central lobe **106*a* arranged upstream with respect to the direction of the washing fluid (flowing towards the outlet opening 105) and a pair of lateral lobes 106*b*, 106*c* opposite one another and arranged downstream of the central lobe 106*a* with respect to the direction of the washing fluid. The three lobes 106*a*, 106*b*, 106*c* are connected together to define a monobloc flow regulator 106**.

The flow regulator 106 acts on the flow of the wash fluid 101 in the conveying means 101 (in particular in the top section 103) so as to slow down the speed of the flow inside of the conveying means 101 and stabilize the outlet jet from outlet opening 105.

The present invention achieves the proposed aims.

In particular, the structure of the spraying device with three elements with the top cover improves the ease of installation and replacement (for example in case of maintenance) as it improves the overall stiffness of the spraying device which can then be easily grasped without risk of damage or breakage.

Moreover, the peculiar construction of the bayonet connection allows a quick coupling and uncoupling of the spraying device by simple rotation (in particular by an angle of approximately 90 degrees) of the spraying device itself.

The use of the bayonet connection also has an additional advantageous effect on the fluid-dynamic tight in the connection between the conduit and spraying device. The bayonet connection, in fact, reduces the losses due to leakage and improves the quality of the axial flow inlet to the impeller. Furthermore, the conical shape of the tip of the pin of the impeller, overlooking from the upper surface of the impeller, improves the fluid-dynamic behavior of the impeller itself, further improved by the structure of the blades which are connected to said conical tip in their portion facing the pin.

The invention claimed is:

1. A spraying device for a washing machine comprising:

an impeller having an axis of rotation and having an upper surface with a central hole extending through the upper surface and equipped with blades, said blades being configured so as to receive an axial flow of a washing fluid and to deviate said flow in a substantially radial direction;

a lower cage defining a containment compartment having an upper access opening to allow an insertion of said impeller in the containment compartment, said lower cage having lateral openings for a delivery of a radial flow coming out of the impeller;

a fastening element provided to firmly connect said lower cage to a frame of the washing machine;

wherein the spraying device further comprises an upper closing cover, firmly applicable on a top of said cage to close the containment compartment from above and having a central hole for the axial flow of the washing fluid to the impeller; and a pin extending from the cage and defining the axis of rotation, and terminating in a conical tip, extending through the central hole of the impeller such that the conical tip is located above the upper surface.

2. The spraying device according to claim 1, wherein said cover has a substantially circular shape.

3. The spraying device according to claim 1, wherein said cage has a connection ring at the top firmly engageable, removably, with an outer peripheral edge of the cover.

4. The spraying device according to claim 3, wherein said connection ring and said outer peripheral edge of the cover are removably connected through one or more elastic snap-fit engagements.

5. The spraying device according to claim 1, wherein said conical tip is overlooking from said upper surface of the impeller in an assembled configuration of the spraying device.

6. The spraying device according to claim 5, wherein the blades of the impeller have a profile linked to said conical tip of the pin at the central through hole of the impeller.

7. The spraying device according to claim 1, wherein said fastening element is at least partially disposed on said cover.

8. The spraying device according to claim 7, wherein said fastening element comprises a bayonet connection seat.

9. The spraying device according to claim 8, wherein said bayonet connection seat is disposed at said central hole of the cover.

10. The spraying device according to claim 8, wherein said bayonet connection seat is defined by a coupling flange extending towards the containment compartment.

11. The spraying device according to claim 8, wherein said bayonet connection seat is located so that a thrust of a flow of washing fluid onto the impeller determines a rotation of the impeller in a same direction as a closing direction of the bayonet connection seat.

12. The spraying device according to claim 1, wherein the impeller comprises a rear wall that is located transversally to an axis of rotation of the impeller and from which the blades are attached; said wall comprising at least one fluid dispensing opening which allows the fluid to cross said rear wall at a smaller diameter than an outer diameter of the impeller.

* * * * *